US006047425A

United States Patent [19]

Khazaal

[11] Patent Number: 6,047,425

[45] Date of Patent: Apr. 11, 2000

[54] ORTHOPEDIC PILLOW

[76] Inventor: Adnan Khazaal, 16000 W. Warren, Detroit, Mich. 48228

[21] Appl. No.: 09/345,841

[22] Filed: Jul. 1, 1999

[51] Int. Cl.[7] ..... A47G 9/02

[52] U.S. Cl. ..... 6/644; 5/640; 5/645

[58] Field of Search ..... 5/636, 637, 640, 5/644, 645

[56] References Cited

U.S. PATENT DOCUMENTS

| | | | |
|---|---|---|---|
| 4,501,034 | 2/1985 | Greenwalt | 5/644 |
| 4,528,705 | 7/1985 | Greenwalt | 5/644 |
| 4,829,614 | 5/1989 | Harper | 5/644 |
| 4,916,765 | 4/1990 | Castronovo, Jr. | 5/636 X |
| 4,918,774 | 4/1990 | Popitz | 5/644 |
| 5,533,218 | 7/1996 | Fahy | 5/636 |
| 5,771,514 | 6/1998 | Wilhoit | 5/644 |

*Primary Examiner*—Michael F. Trettel

[57] ABSTRACT

A orthopedic pillow for providing relief to user's neck and upper back pain. The orthopedic pillow includes an inflatable bladder comprises a spaced apart pair of end lobes and a plurality of middle lobes interposed between the end lobes of the inflatable bladder. An outer pad substantially covers the inflatable bladder. A resiliently deformable sheet is embedded in the outer pad between the upper contours of the outer pad and the top faces of the lobes of the inflatable bladder.

7 Claims, 3 Drawing Sheets

ORTHOPEDIC PILLOW

BACKGROUND OF THE INVENTION

1. Field of the Invention

The present invention relates to orthopedic pillows and more particularly pertains to a new orthopedic pillow for providing relief to user's neck and upper back pain.

2. Description of the Prior Art

The use of orthopedic pillows is known in the prior art. More specifically, orthopedic pillows heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,528,705; U.S. Pat. No. 5,708,999; U.S. Pat. No. 4,918,774; U.S. Pat. No. 4,979,249; U.S. Pat. No. 2,522,120; and U.S. Pat. No. Des. 351,526.

While these devices fulfill their respective, particular objectives and requirements, the aforementioned patents do not disclose a new orthopedic pillow. The inventive device includes an inflatable bladder comprises a spaced apart pair of end lobes and a plurality of middle lobes interposed between the end lobes of the inflatable bladder. An outer pad substantially covers the inflatable bladder. A resiliently deformable sheet is embedded in the outer pad between the upper contours of the outer pad and the top faces of the lobes of the inflatable bladder.

In these respects, the orthopedic pillow according to the present invention substantially departs from the conventional concepts and designs of the prior art, and in so doing provides an apparatus primarily developed for the purpose of providing relief to user's neck and upper back pain.

SUMMARY OF THE INVENTION

In view of the foregoing disadvantages inherent in the known types of orthopedic pillows now present in the prior art, the present invention provides a new orthopedic pillow construction wherein the same can be utilized for providing relief to user's neck and upper back pain.

The general purpose of the present invention, which will be described subsequently in greater detail, is to provide a new orthopedic pillow apparatus and method which has many of the advantages of the orthopedic pillows mentioned heretofore and many novel features that result in a new orthopedic pillow which is not anticipated, rendered obvious, suggested, or even implied by any of the prior art orthopedic pillows, either alone or in any combination thereof.

To attain this, the present invention generally comprises an inflatable bladder comprises a spaced apart pair of end lobes and a plurality of middle lobes interposed between the end lobes of the inflatable bladder. An outer pad substantially covers the inflatable bladder. A resiliently deformable sheet is embedded in the outer pad between the upper contours of the outer pad and the top faces of the lobes of the inflatable bladder.

There has thus been outlined, rather broadly, the more important features of the invention in order that the detailed description thereof that follows may be better understood and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new orthopedic pillow apparatus and method which has many of the advantages of the orthopedic pillows mentioned heretofore and many novel features that result in a new orthopedic pillow which is not anticipated, rendered obvious, suggested, or even implied by any of the prior art orthopedic pillows, either alone or in any combination thereof.

It is another object of the present invention to provide a new orthopedic pillow which may be easily and efficiently manufactured and marketed.

It is a further object of the present invention to provide a new orthopedic pillow which is of a durable and reliable construction.

An even further object of the present invention is to provide a new orthopedic pillow which is susceptible of a low cost of manufacture with regard to both materials and labor, and which accordingly is then susceptible of low prices of sale to the consuming public, thereby making such orthopedic pillow economically available to the buying public.

Still yet another object of the present invention is to provide a new orthopedic pillow which provides in the apparatuses and methods of the prior art some of the advantages thereof, while simultaneously overcoming some of the disadvantages normally associated therewith.

Still another object of the present invention is to provide a new orthopedic pillow for providing relief to user's neck and upper back pain.

Yet another object of the present invention is to provide a new orthopedic pillow which includes an inflatable bladder comprises a spaced apart pair of end lobes and a plurality of middle lobes interposed between the end lobes of the inflatable bladder. An outer pad substantially covers the inflatable bladder. A resiliently deformable sheet is embedded in the outer pad between the upper contours of the outer pad and the top faces of the lobes of the inflatable bladder.

Still yet another object of the present invention is to provide new orthopedic pillow that helps alleviate neck and back pain for ed confined users.

Even still another object of the present invention is to provide a new orthopedic pillow that is adjustably inflatable to increase or decrease the firmness of the orthopedic pillow to suit the comfort and needs of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
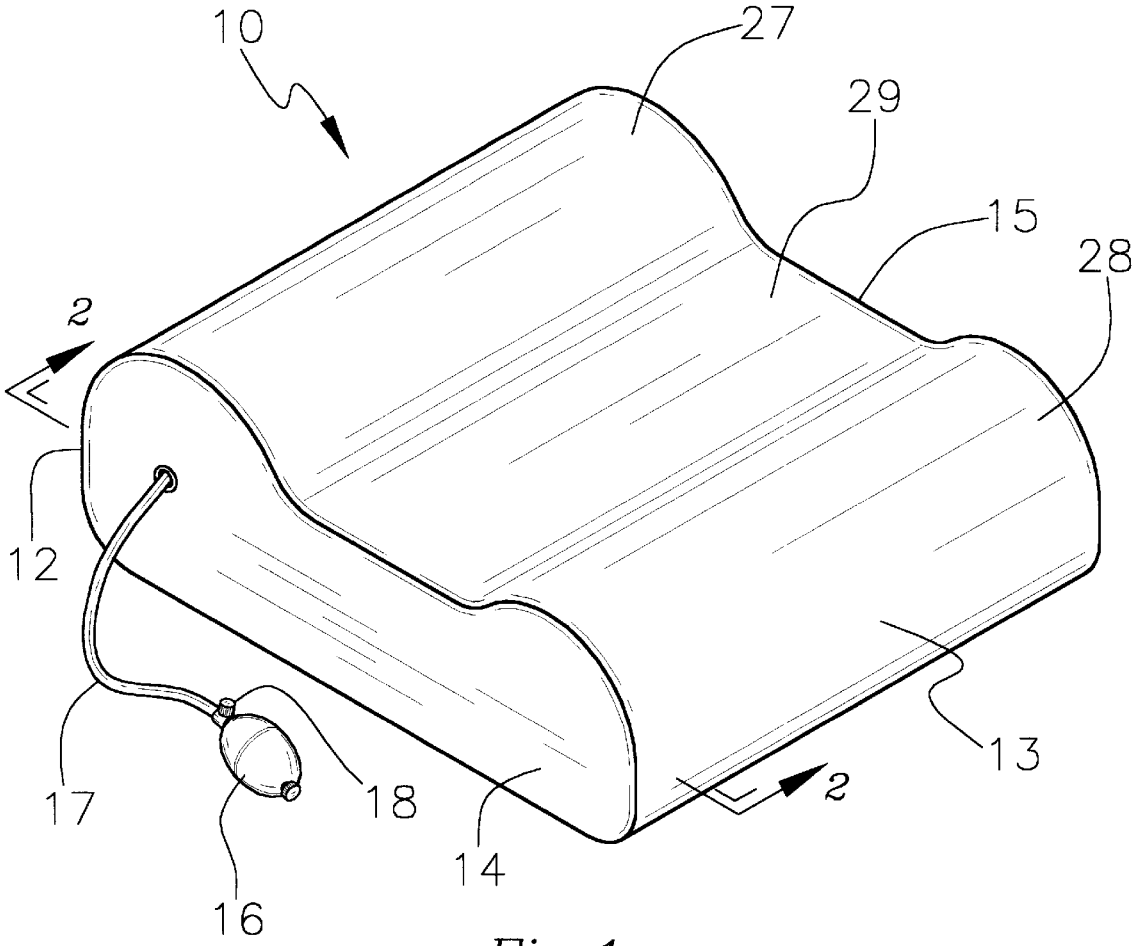
FIG. 1 is a schematic perspective view of a new orthopedic pillow according to the present invention.
Figure 2:
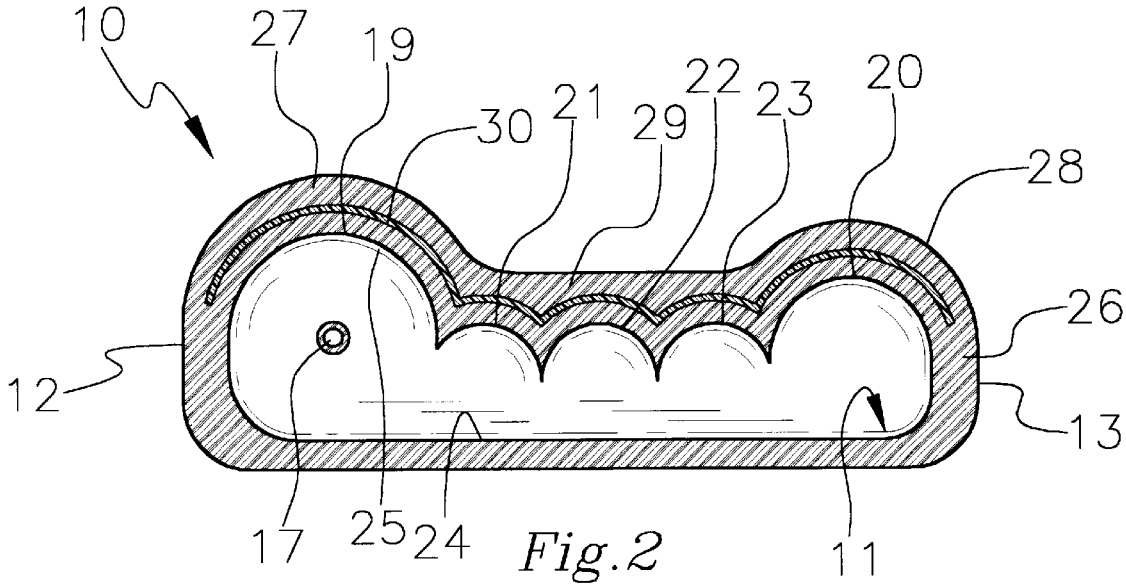
FIG. 2 is a schematic cross sectional view of the present invention taken from line 2-2 of FIG. 1.
Figure 3:
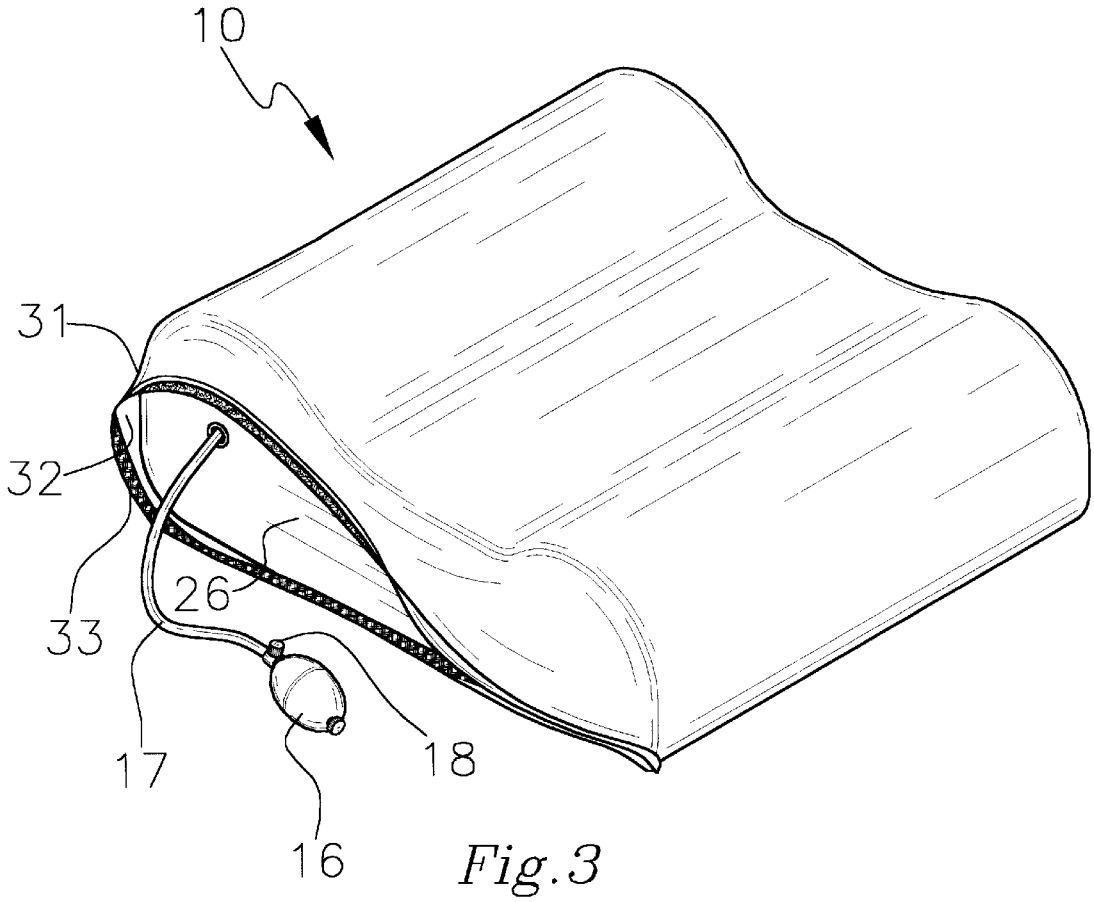
FIG. 3 is a schematic perspective view of the present invention in combination with a pillow cover.

With reference now to the drawings, and in particular to FIGS. 1 through 3 thereof, a new orthopedic pillow embodying the principles and concepts of the present invention and generally designated by the reference numeral 10 will be described.

As best illustrated in FIGS. 1 through 3, the orthopedic pillow 10 generally comprises an inflatable bladder comprises a spaced apart pair of end lobes and a plurality of middle lobes interposed between the end lobes of the inflatable bladder. An outer pad substantially covers the inflatable bladder. A resiliently deformable sheet is embedded in the outer pad between the upper contours of the outer pad and the top faces of the lobes of the inflatable bladder.

In closer detail, the orthopedic pillow comprises an inflatable bladder 11 having a pair of opposite ends 12,13, and a pair of sides 14,15 extending between the ends of the inflatable bladder. The inflatable bladder comprises a resiliently stretchable material such as a resiliently stretchable latex material. The inflatable bladder has a length defined between the ends of the inflatable bladder and a width defined between the sides of the inflatable bladder. In an ideal embodiment, the length of the inflatable bladder is about 20 inches and the width of the inflatable bladder is about 28 inches.

A hand pump 16 is in fluid communication with the inflatable bladder for inflating the inflatable bladder. Preferably, an elongate flexible tube 17 fluidly connects the hand pump with the inflatable bladder. Ideally, the flexible tube is outwardly extended from one of the sides of the inflatable bladder. The hand pump also has a release valve 18 for permitting selective deflation of the inflatable bladder.

As best illustrated in FIG. 2, the inflatable bladder comprises a spaced apart pair of end lobes 19,20 and a plurality of middle lobes 21,22,23 interposed between the end lobes of the inflatable bladder. A first of the end lobes 19 is positioned adjacent one end of the inflatable bladder and a second of the end lobes 20 is positioned adjacent the other of the ends of the inflatable bladder. The lobes each has a longitudinal axis extending between the sides of the inflatable bladder and generally parallel to one another.

As shown in FIG. 2, the lobes have bottom faces 24 lying in a common plane with one another. The lobes also each haste an arcuate top face 25. Each arcuate top face has a transverse cross section taken substantially perpendicular to the longitudinal axis of the respective lobe. The transverse cross section of each lobe has a concavity facing downwards towards the bottom face of the respective lobe and an upwardly outwardly facing convexity.

The top face of each lobe has an rounded apex defined at a point on the top face furthest away from the bottom face of the respective lobe. Each of the lobe has a height defined between the apex and the bottom face of the respective lobe when the inflatable bladder is fully inflated. The height of the first end lobe is greater than height of the second end lobe and the height of each of the middle lobes when the inflatable bladder is fully inflated. The height of the second end lobe is greater than height of each of the middle lobes when the inflatable bladder is fully inflated. Preferably, the heights of the middle lobes are about equal to one another when the inflatable bladder is fully inflated. In an ideal illustrative embodiment, when the inflatable bladder is fully inflated, the height of the first end lobe is about 7 inches, the height of the second end lobe is about 6 inches, and the height of each of the middle lobes is about 4 inches.

Figure 4:
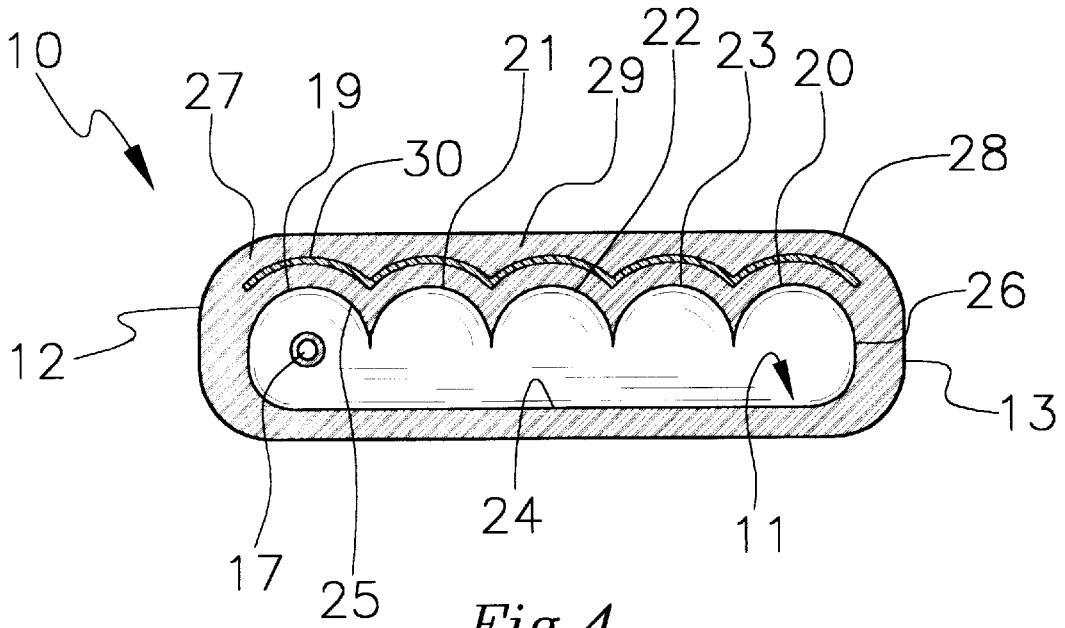
FIG. 4 is a schematic cross sectional view of an embodiment of the present invention having end lobes of generally equal height as the middle lobes.

FIG. 4 illustrates another preferred embodiment of the pillow having end lobes of generally equal heights as the middle lobes. This embodiment is optimal for users who find the raised end lobes uncomfortable.

A resiliently deformable outer pad 26 substantially covers the inflatable bladder such that the inflatable bladder is enclosed in the outer pad. The outer pad preferably comprises a resiliently deformable fine polyester fiber material. The outer pad has a spaced apart pair of end regions 27,28 each having an arcuate upper contour corresponding to the arcuate top face of an associated adjacent end lobe of the inflatable bladder. The outer pad also has a middle region 29 interposed between the end regions of the outer pad and having a generally flat upper contour extending over the arcuate top faces of the middle lobes of the inflatable bladder.

A generally rectangular resiliently deformable sponge material sheet 30 is embedded in the outer pad between the upper contours of the regions of the outer pad and the arcuate top faces of the lobes of the inflatable bladder.

A removable protective pillow cover 31 may be included for substantially covering the orthopedic pillow. The pillow cover comprises a fabric material and has a side opening 32, the flexible tube is outwardly extended through the side opening. The pillow cover has a closure fastener 33 (such as a hook and loop fastener along the periphery of the side opening) for closing the side opening.

In use, the orthopedic pillow is designed for resting the head of a user thereon to help relieve neck and upper back pain. The orthopedic pillow may also be used to support other parts of a user's body as desired such as a user's extremities including the user's arms and legs, or as a seat pad, or even a lower back pad. The hand pump may be used to inflate the inflatable bladder to achieve a desired firmness for the orthopedic pillow. If a user desires a less firm pillow, the release valve may be opened to deflate the inflatable bladder to make the orthopedic pillow softer or less firm.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An orthopedic pillow, comprising:

an inflatable bladder comprising a spaced apart pair of end lobes and a plurality of middle lobes interposed between said end lobes of said inflatable bladder;

said lobes each having a longitudinal axis extending generally parallel to one another;

said lobes having bottom faces lying in a common plane with one another;

said lobes each having an arcuate top face, each arcuate top face having a transverse cross section taken substantially perpendicular to said longitudinal axis of the respective lobe, said transverse cross section of each lobe having a concavity facing towards said bottom face of the respective lobe and an outwardly facing convexity;

an outer pad substantially covering said inflatable bladder;

said outer pad having a spaced apart pair of end regions each having an arcuate upper contour corresponding to said arcuate top face of an associated adjacent end lobe of said inflatable bladder, said outer pad having a middle region interposed between said end regions of said outer pad, said middle region of said outer pad having a generally flat upper contour extending over said arcuate top faces of said middle lobes of said inflatable bladder;

a resiliently deformable sheet being embedded in said outer pad between said upper contours of said regions of said outer pad and said arcuate top faces of said lobes of said inflatable bladder.

2. The orthopedic pillow of claim 1, further comprising a hand pump being in fluid communication with said inflatable bladder for inflating said inflatable bladder.

3. The orthopedic pillow of claim 2, wherein an elongate flexible tube fluidly connects said hand pump with said inflatable bladder, said flexible tube being outwardly extended from one of said sides of said inflatable bladder.

4. The orthopedic pillow of claim 1, wherein said hand pump has a release valve for permitting deflation of said inflatable bladder.

5. The orthopedic pillow of claim 1, wherein said top face of each lobe have an apex defined at a point on said top face furthest away from said bottom face of the respective lobe, wherein each of said lobe has a height defined between said apex and said bottom face of the respective lobe when said inflatable bladder is fully inflated, wherein said height of said first end lobe is greater than height of said second end lobe and said height of each of said middle lobes, and wherein said height of said second end lobe is greater than height of each of said middle lobes.

6. The orthopedic pillow of claim 5, wherein said heights of said middle lobes are about equal to one another.

7. In combination:

an orthopedic pillow comprising:

an inflatable bladder, an outer pad, having a pair of opposite ends, and a pair of sides extending between said ends of said inflatable bladder;

said inflatable bladder comprising a resiliently stretchable material;

a hand pump being in fluid communication with said inflatable bladder for inflating said inflatable bladder, wherein an elongate flexible tube fluidly connects said hand pump with said inflatable bladder, said flexible tube being outwardly extended from one of said sides of said inflatable bladder, said hand pump having a release valve for permitting deflation of said inflatable bladder;

said inflatable bladder comprising a spaced apart pair of end lobes and a plurality of middle lobes interposed between said end lobes of said inflatable bladder;

a first of said end lobes being positioned adjacent one end of said inflatable bladder, a second of said end lobes being positioned adjacent the other of said ends of said inflatable bladder;

said lobes each having a longitudinal axis extending between said sides of said inflatable bladder, said longitudinal axes of said lobes being extended generally parallel to one another;

said lobes having bottom faces lying in a common plane with one another;

said lobes each having an arcuate top face, each arcuate top face having a transverse cross section taken substantially perpendicular to said longitudinal axis of the respective lobe, said transverse cross section of each lobe having a concavity facing towards said bottom face of the respective lobe and an outwardly facing convexity;

said top face of each lobe having an apex defined at a point on said top face furthest away from said bottom face of the respective lobe;

each of said lobe having a height defined between said apex and said bottom face of the respective lobe when said inflatable bladder is fully inflated;

wherein said height of said first end lobe is greater than height of said second end lobe and said height of each of said middle lobes;

wherein said height of said second end lobe is greater than height of each of said middle lobes;

wherein said heights of said middle lobes are about equal to one another;

wherein said height of said first end lobe is about 7 inches, wherein said height of said second end lobe is about 6 inches, and wherein said height of each of said middle lobes is about 4 inches;

an resiliently deformable outer pad substantially covering said inflatable bladder such that said inflatable bladder is enclosed in said outer pad, said outer pad comprising a resiliently deformable fine polyester fiber material;

said outer pad having a spaced apart pair of end regions each having an arcuate upper contour corresponding to said arcuate top face of an associated adjacent end lobe of said inflatable bladder, said outer pad having a middle region interposed between said end regions of said outer pad, said middle region of said outer pad having a generally flat upper contour extending over said arcuate top faces of said middle lobes of said inflatable bladder;

a generally rectangular resiliently deformable sponge material sheet being embedded in said outer pad between said upper contours of said regions of said outer pad and said arcuate top faces of said lobes of said inflatable bladder; and a removable pillow cover substantially covering said orthopedic pillow, said pillow cover comprising a fabric material and having a side opening, said flexible tube being outwardly extended through said side opening, said pillow cover having a closure for closing said side opening.

* * * * *